US007254901B2

(12) United States Patent
Blann et al.

(10) Patent No.: US 7,254,901 B2
(45) Date of Patent: Aug. 14, 2007

(54) WASHER/DRYER PLUMBING CONNECTION AND METHOD

(75) Inventors: Willie E. Blann, Euless, TX (US); Richard A. Schlenk, Corsicana, TX (US)

(73) Assignee: Contemporary Contractors, Inc., Irving, TX (US)

( * ) Notice: Subject to any disclaimer, the term of this patent is extended or adjusted under 35 U.S.C. 154(b) by 136 days.

(21) Appl. No.: 10/911,074

(22) Filed: Aug. 4, 2004

(65) Prior Publication Data

US 2006/0026860 A1 Feb. 9, 2006

(51) Int. Cl.
*F26B 11/02* (2006.01)

(52) U.S. Cl. ..... 34/595

(58) Field of Classification Search ..... 34/595, 34/601, 603; 68/13 R, 19
See application file for complete search history.

(56) References Cited

U.S. PATENT DOCUMENTS

| | | | | |
|---|---|---|---|---|
| 1,389,608 A | | 9/1921 | Trueman | |
| 2,750,779 A | * | 6/1956 | Whyte | 68/19 |
| 3,331,226 A | * | 7/1967 | Fink | 68/20 |
| 4,162,546 A | | 7/1979 | Shortell | 4/191 |
| 4,811,431 A | | 3/1989 | Kraverath | 4/191 |
| 5,635,058 A | | 6/1997 | Bowman | 210/172 |
| 5,676,319 A | | 10/1997 | Stiggins et al. | 241/46.012 |
| 6,019,894 A | | 2/2000 | Batten | 210/175 |
| 6,588,803 B2 | | 7/2003 | Vila | 285/134.1 |
| 6,651,272 B2 | | 11/2003 | Bowman | 4/679 |
| 2005/0056059 A1 | * | 3/2005 | Usherovich et al. | 68/12.02 |

OTHER PUBLICATIONS

"Pop-up Problems" website article located at http://www.onthehouse.com/articles/apimages/602.gif, dated Jul. 23, 2004, 1 page (copy enclosed).

"All About Sink Drains" website article for On The House with the Carey Bros. located at http://www.onthehouse.com/print.php?short_name=wp&article_date=20030106, dated Jul. 23, 2004, 3 pages (copy enclosed).

"Projects Online: Replacing a Leaky Kitchen Sink Strainer" website article by Creative Homeowner located at http://www.creativehomeowner.com/index.php?pane=project&projectid=chplm009, dated Jul. 26, 2004, 3 pages (copy enclosed).

"Replacing a Bathroom Faucet" website article by Easy2Technologies located at http://www.easy2diy.com/cm/easy/diy_ht_index.asp?page_id=35694478, dated Jul. 26, 2004, 4 pages (copy enclosed).

(Continued)

*Primary Examiner*—S. Gravini
(74) *Attorney, Agent, or Firm*—Hunton & Williams LLP

(57) ABSTRACT

A tailpiece has been provided that includes a tubular member, a washing machine connector, and a dryer drainage connector. The washing machine connector can receive a fluid discharge from a washing machine drain line and the dryer drainage connector can receive a fluid discharge from a dryer drain line. In some configurations, the tailpiece include ports. The ports have a plug positioned within them when they are not being utilized and a connector positioned within them when they are being utilized. Additionally, a method of installing a tailpiece beneath a sink has been provided.

22 Claims, 4 Drawing Sheets

OTHER PUBLICATIONS

"Replacing a Bathroom Sink" website article by Lowe's located at http://www.lowes.com/1kn?action=howTo&p=Improve/RepBthSink.html&rn=RightNavFiles/righ..., dated Jul. 23, 2004, 4 pages (copy enclosed).

"How to Install an Integral Sink-Countertop" website article by Black&Decker located at http://www.blackanddecker.com/ProjectCenter/DocumentView.aspx?DOC_ID=p_2_53_16404_1..., dated Jul. 23, 2004, 2 pages (copy enclosed).

"Installing PVC Kitchen Sink Drain Plumbing" website article for HammerZone located at http://www.hammerzone.com/archives/kitchen/sink/stainless/drain.htm, dated Jul. 23, 2004, 4 pages (copy enclosed).

"Kitchen Sink Plumbing" website article located at http://www.hometips.com/hyhw/plumbing/78sinks.html, dated Jul. 26, 2004, 1 page (copy enclosed).

Faucet supply pages (page nos. 736 and 737) from ProBook, The Home Depot 1999 edition, 4 pages (copy enclosed).

* cited by examiner

WASHER/DRYER PLUMBING CONNECTION AND METHOD

TECHNICAL FIELD OF THE INVENTION

The present invention relates generally to the field of plumbing and more particularly, but not by way of limitation, to a washer/dryer plumbing connection.

BACKGROUND OF THE INVENTION

A new generation of dryers have been developed that do not require traditional venting. Such dryers (in lieu of traditional venting) vent into a box or the like and drop condensate into a tray. A device exemplary of such dryers is ASKO Dryer Model No. T721, manufactured by ASKO, a Swedish Company. These dryers afford an ability to install a dryer in areas that do not have venting capabilities. As an example, some facilities, buildings (e.g., an apartment building), and/or complexes were not designed for washers/dryers to be installed therein. That is, these facilities, buildings, and/or complexes do not include the requisite washer/dryer hookups. The dryers become a potential solution in making washer/dryers available in such facilities, buildings, and/or complexes. However, the installation of such dryers only address part of the problem. That is, most buildings, in addition to lacking venting capabilities, lack drainage capabilities. Thus, concern lies with how to handle fluid discharge—not only from the newly created dryer condensate, but also from the washing machines typically installed therewith. As referenced above, condensate from the dryer can collect in a tray. Such trays can be dumped periodically; however, such a dumping can becomes tedious. And, mold problems can develop if the tray were to leak or if an individual forgot to the dump the tray.

One potential solution for both the washing machine drainage and dryer condensate drainage involves creating a new drainage line that ties into existing plumbing lines (e.g., opening a wall of the building and running a copper line to the plumbing line). However, such a solution can be a tedious work process, especially for an ordinary consumer who seeks accomplish a task in a "do it yourself" project. Further exacerbating the problem is the fact that in order to tie into an existing plumbing line, knowledge is needed as to the location of the plumbing system. Additionally, care must be taken to ensure that there is a sufficient pressure head drop between the outlet of the washer/dryer to allow the fluid to flow (e.g., the fluid must be able to flow by gravity to the plumbing).

SUMMARY OF THE INVENTION

From the foregoing it may be appreciated that a need has arisen for a washer/dryer plumbing connection and method. In accordance with the present invention, a washer/dryer plumbing connection and method has been provided that substantially eliminates one or more of the disadvantages and problems outlined above.

According to an aspect of the present invention, a tailpiece operable to be positioned in plumbing below a sink has been provided which comprises a tubular member, a washing machine connector, and a dryer drainage connector. The tubular member has a first end and a second end; the washing machine connector is operable to receive a fluid discharge from a washing machine drain line; and, the dryer drainage connector is operable to receive a fluid discharge from a dryer drain line.

According to another aspect of the present invention, a method of allowing a washer/dryer discharge through piping has been provided which comprises positioning a tailpiece below a sink, wherein the tailpiece includes a tubular member having a first end and a second end, the first end is a first fluid inlet for the tubular member, operable to receive fluid from the sink, and, the second end is a fluid outlet for the tubular member, operable to discharge fluid to the piping; coupling a washing machine drain line to the tubular member such that fluid discharged from the washing machine drain line can be channeled through the second end of the tubular member out to the piping; and coupling a dryer drain line to the tubular member such that fluid discharged from dryer drain line can be channeled through the second end of the tubular member to the piping.

According to yet another aspect of the present invention, a tailpiece operable to be positioned in plumbing below a sink has been provided which comprises a tubular member and at least one port in the tubular member. The tubular member has a first end and a second end. The at least one port is operable to receive a connector when the port is being utilized; and, the at least one port is operable to receive a plug when the port is not being utilized.

The various embodiments and implementations of the present invention provide a profusion of potential technical advantages and benefits. A technical advantage of the present invention may include the capability to facilitate a quick drainage hook-up for washer and/or dryer drain lines to piping in a building.

Another technical advantage of the present invention may include the capability to replace an existing tailpiece beneath a sink with an improved tailpiece capable of additional operations.

Yet another technical advantage of the present invention may include the capability to facility drainage from a plurality of devices through a single tailpiece.

Other technical advantages may be readily apparent to one skilled in the art after review of following figures and description, associated herewith.

BRIEF DESCRIPTION OF THE DRAWINGS

For a more complete understanding of the present invention and the advantages thereof, reference is now made to the following brief description, taken in connection with the accompanying drawings and detailed description, wherein like reference numerals represent like parts, in which.

DETAILED DESCRIPTION OF THE INVENTION

It should be understood at the outset that although an exemplary implementation of the present invention is illustrated below, the present invention may be implemented using any number of techniques, whether currently known or in existence. The present invention should in no way be limited to the exemplary implementations, drawings, and techniques illustrated below, including the exemplary design and implementations illustrated and described herein. Additionally, the drawings contained herein are not necessarily drawn to scale.

FIGS. 1-12 show several configurations of tailpieces 20, 30 that are operable for positioning below a sink (e.g., a kitchen sink 140 or a bathroom sink 160). While specific configurations of the tailpieces 20,30 are shown and described herein, it should be expressly understood that the tailpieces 20,30 can have other configurations that will become apparent to one of ordinary skill in the art—such configurations including not only those are now known, but also those that will be later developed.

Figure 1:
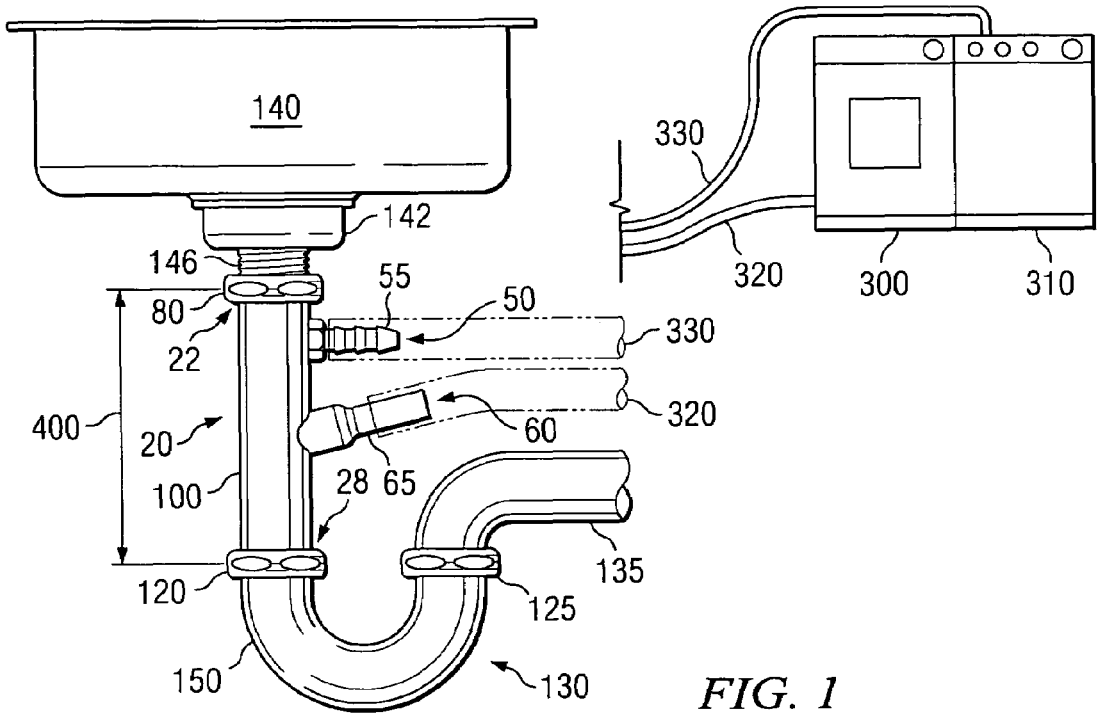
FIG. 1 is a side perspective view of a tailpiece, according to an embodiment of the invention, connected to a kitchen sink.

FIG. 1 shows a configuration of a tailpiece 20, according to an embodiment of invention. The tailpiece 20 is shown positioned beneath a kitchen sink 140. For ease of illustration and purposes of brevity, the detailed component parts under the kitchen sink 140 will not be described; rather, only the basic general component parts will be described. In this configuration, the basic general component parts under the kitchen sink 140 include a strainer 142 and piping 130. In a standard configuration, a third piece (e.g., a standard tailpiece or straight piece of tubing, not shown) can be positioned between the strainer 142 and the piping 130 to transport fluid from the strainer 142 to the piping 130. The piping 130 is generally the system or network of pipes utilized to connect the sink 140 and the standard tailpiece to a drainage system within a building. For ease of illustration, the piping 130 in this configuration only includes nuts 120 and 125, a trap 150, and an outlet pipe 135. However, it will be recognized by those skill in the art that the piping 130 can take on virtual limitless number of configurations.

According to one aspect of the invention, the standard tailpiece is modified and/or replaced to facilitate additional operations, namely the facilitation of a fluid discharge from a washer 300 and/or dryer 310. FIG. 1 generally shows a configuration of a tailpiece 20, according to this aspect of the invention. Once again, while a specific configuration of the tailpiece 20 is shown and described, other configurations of the tailpiece 20 will become apparent to one of ordinary skill in the art. Several configurations of the tailpiece 20 will be described below with reference to FIGS. 3-5.

The tailpiece 20 in the configuration of FIG. 1 is generally shown with a tubular member 100, a nut 80, a dryer drainage connector 55, and a washing machine connector 65. The tubular member 100 has a first end 22, which generally defines a first fluid inlet 40 (seen in FIGS. 3-5) and a second end 28, which generally defines a fluid outlet 70 (seen in FIGS. 3-5). The nut 80 is positioned on the first end 22 of the tubular member 100 and allows the tailpiece 20 to couple to a threaded portion 146 on the base of the strainer 142.

The second end 28 of the tailpiece 20 can generally be arranged and designed such that a nut 120 (e.g., a slip joint nut) from the piping 130 can couple thereto. It will be recognized by one of ordinary skill in the art that a distance 400 between the strainer 142 and the nut 120 can vary according to the different configurations underneath a kitchen sink 140. As such, the length 410 (shown in FIG. 3) of the tubular member 100 can vary accordingly with the different configurations. For example, the second end 28 can be adjustable—that is, a portion of the second end 28 can be cut off—to allow for positioning of the tailpiece 20 between the strainer 142 and the nut 120. With an adjustable configuration, the tailpiece 20 can be provided in a plurality of standard sizes (e.g., 6" or 12") and adjusted for a specific configurations beneath the kitchen sink 140.

Shown coupled to the side of the tubular member 100 of the tailpiece 20 are the dryer drainage connector 55, which generally defines a second fluid inlet 50 in this configuration, and the washing machine connector 65, which generally defines a third fluid inlet 60 in this configuration. The dryer drainage connector 55 is generally arranged and designed to receive a dryer drain line 330 from the dryer 310 (the dryer drain line 330 is shown in ghosted view as it approaches the dryer drainage connector 55) while the washing machine connector 65 is generally arranged and designed to receive a washing machine drain line 320 from the washer 300 (the washing machine drain line 320 is shown in ghosted view as it approaches the washing machine connector 65).

The dryer drainage connector 55 in the configuration of FIG. 1 is shown with a barbed configuration and preferably has a ¼ inch internal diameter. The washing machine connector 65 in the configuration of FIG. 1 is shown with a "slip-on" configuration (e.g., smooth tubing with a beveled head to facilitate placemen of a line thereon) and preferably has a ¾ inch internal diameter. With this slip-on configuration, the washing machine drain line 320 can be held onto the washing machine connector 65 via clamps or the like. While such configurations are shown, it should be understood that other configuration and sizes can be utilized as will become apparent to one of ordinary skill in the art. As an example, intended for illustrative purposes only, both the dryer drainage connector 55 and the washing machine connector 65 can be barbed or both the dryer drainage connector 55 and the washing machine connector 65 can be "slip-on" configurations. To a certain extent, the sizes and/or configurations of the connectors (dryer drainage connector 55 and the washing machine connector 65) can depend on the lines being coupled thereto and the flow rate and flow volume of fluid through such lines. In the configuration of FIG. 1, the flow rate and flow volume through the dryer drain line 330 is less than the flow rate and flow volume through the washing machine drain line 320. As such, the dryer drainage connector 55 has a smaller diameter connection than the washing machine connector 65.

Figure 2:
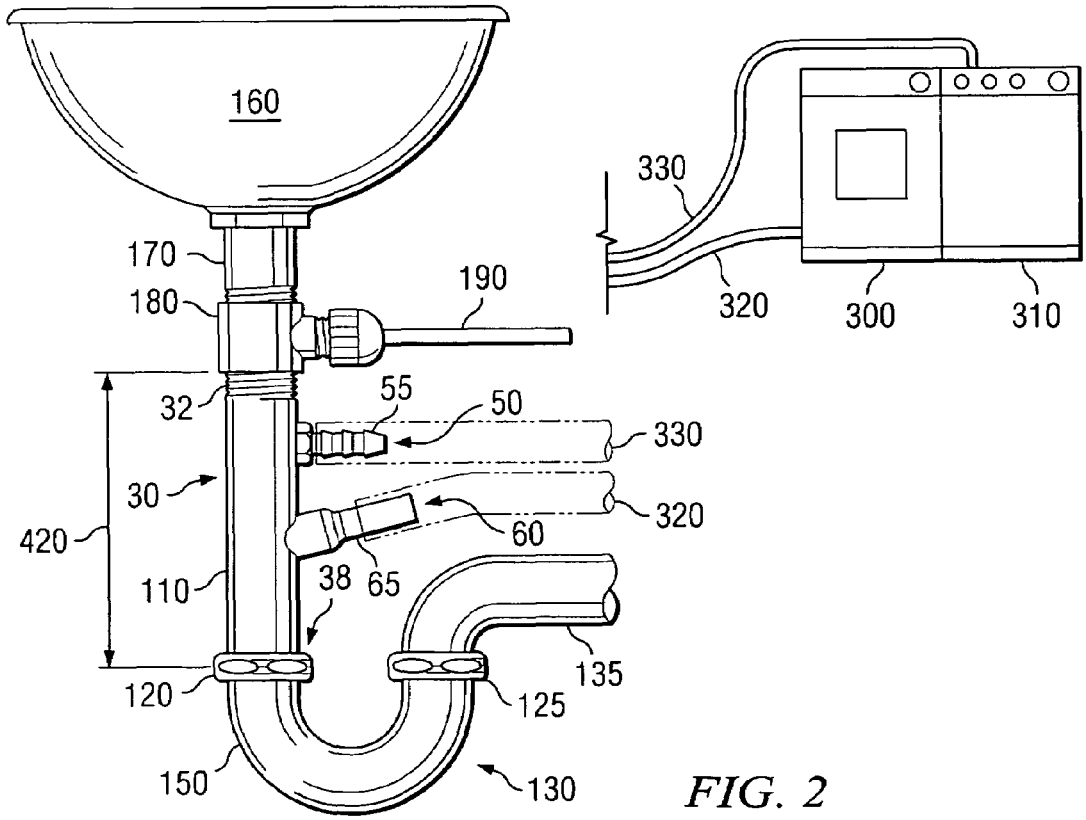
FIG. 2 is a side perspective view of a tailpiece, according to an embodiment of the invention, connected to a bathroom sink.

FIG. 2 shows a configuration of the tailpiece 30, according to another embodiment of invention. The tailpiece 30 is shown positioned beneath a bathroom sink 160. FIG. 2 has similar features to FIG. 1, except that the basic component parts under the bathroom sink 160 are different; and, as such, the tailpiece 30 is correspondingly modified. Similar to FIG. 1, for ease of illustration and purposes of brevity, the detailed component parts under the bathroom sink 160 of FIG. 2 will not be described; rather, only general component parts will be referenced. The component parts under the bathroom sink 160 of FIG. 2 include a sink drain 170, a pop-up connector or T-connector 180, a pivot rod 190, and the piping 130. The operation of such component parts should become apparent to one of ordinary skill in the art. As an example, intended for illustrative purposes only, the pivot rod 190 is actuated to initiate movement of the pop-up stopper within the pop-up connector or T-connector 180.

The tailpiece 30 in this configuration is generally shown with a tubular member 110, a dryer drainage connector 55, and a washing machine connector 65. The tubular member 110 has a first end 32, which generally defines a first fluid inlet 40 (seen in FIGS. 6-8) and a second end 38, which generally defines a fluid outlet 70 (seen in FIGS. 6-8). The first end 32 of the tubular member 110 is threaded (seen in FIGS. 6-8) to allow for positioning within the T-connector 180.

Similar to the tailpiece 20 of FIG. 1, the second end 38 of the tailpiece 30 of FIG. 2 can generally be arranged and designed such that a nut 120 (e.g., a slip joint nut) from the piping 130 can couple thereto; and a length 430 (shown in FIG. 6) of the tubular member 110 can vary accordingly with the different configurations underneath the bathroom sink 160. For example, the second end 38 can be adjustable—that is, a portion of the second end 38 can be cut off—to allow for positioning between different distances 420 between the T-connector 180 and the nut 120. With an adjustable configuration, the tailpiece 30 can be provided in a plurality of standard sizes (e.g., 6" or 12") and adjusted for a specific configuration.

Figure 5:
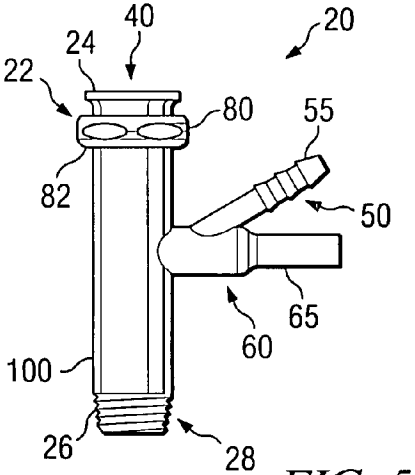
FIGS. 3-5 are configurations of a tailpiece that can connect to a kitchen sink.
Figure 4:
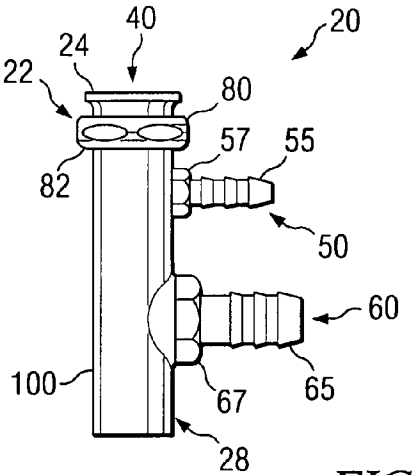
Figure 3:
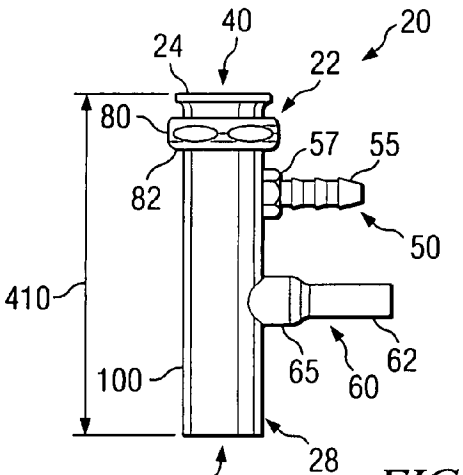

FIGS. 3-5 are generally illustrative of configurations of the tailpiece 20 that can be utilized below a kitchen sink 140. The tailpieces 20 of FIGS. 3-5 generally include a tubular member 100, a dryer drainage connector 55 (that defines a second fluid inlet 50), a washing machine connector 65 (that defines a third fluid inlet 60), and a nut 80. The tubular members 100 include a first end 22 (that defines a first fluid inlet 40) and a second end 28 (that defines a fluid outlet 70). The first end 22 of the tailpieces 20 are shown with a lip 24. A bottom portion 82 of the nut 80 mates with the lip 24 upon coupling (e.g., via a threading rotation) the tailpiece 20 to the threaded portion 146 of the base of the strainer 142. As referenced above, the second end 28 of tailpiece 20 can be adjustable—e.g., the second end 28 can be a slick portion of the tubular member 100 that can be cut down to decrease the length 410.

FIG. 3 generally shows a barbed dryer drainage connector 55 and a slip-on washing machine connector 65. At the base of the dryer drainage connector 55 is a hexagonal nut 57, which can facilitate placement of the dryer drainage connector 55 on the tubular member 100. The slip-on washing machine connector 65 as shown in FIG. 3 can be welded onto to the tubular member 100. Other configurations and/or techniques of placing the dryer drainage connector 55 and the washing machine connector 65 on the tubular member 100 should become apparent to one of ordinary skill in the art—such configurations and/or techniques, including not only those that are now known, but also those that will be later developed.

FIG. 4 generally shows a barbed dryer drainage connector 55 with a hexagonal nut 57 at the base and a barbed washing machine connector 65 with a hexagonal nut 67 at the base. FIGS. 3 and 4 are intended as illustrating that a variety of techniques can be utilized to couple the dryer drainage connector 55 to the dryer drain line 330 (FIG. 1) and washing machine connector 65 to the washing machine drain line 320 (FIG. 1). For example, the washing machine connector 65 of FIG. 3 can utilize a beveled edge 62 to position and clamps or the like to hold a washing machine drain line 320 (FIG. 1) thereon. The washing machine connector 65 of FIG. 4 can utilize barbed edges to position and hold a washing machine drain line 320 (FIG. 1) thereon. Other configurations and/or techniques for positioning and holding washing machine drain lines 320 to washing machine connectors 65 and dryer drain lines 330 to dryer drainage connectors 55 should become apparent to one of ordinary—such configurations and/or techniques, including not only those that are now known, but also those that will be later developed.

In FIG. 5, the second fluid inlet 50 (in this configuration, a dryer drainage connector 55) is a branch off the third fluid inlet 60 (in this configuration, a washing machine connector 65). As such, the tubular member 100 is shown with only two direct fluid inlets, the first fluid inlet 40 and the third fluid inlet 60. Similar branching techniques can be utilized in other configurations of the tailpiece 20. As an example, intended for illustrative purposes only, the second fluid inlet 50 could be branched off the washing machine drain line 320 (FIG. 1) at a substantial distance from the tailpiece 20 (e.g., at a location proximate to washer 300 and/or dryer 310).

Additionally shown in FIG. 5 is a threading 26 on the second end 28 of the tubular member 100. Such a threading 26 may be desirable in some configurations. In configurations in which threading 26 is desirable on the second end 28 and the second end 28 is also desired to be adjustable, the threading 26 can simply extend a length up the tubular member 100 such that the threading 26 will be present upon a cutting off a portion of the second end 28.

Figure 8:
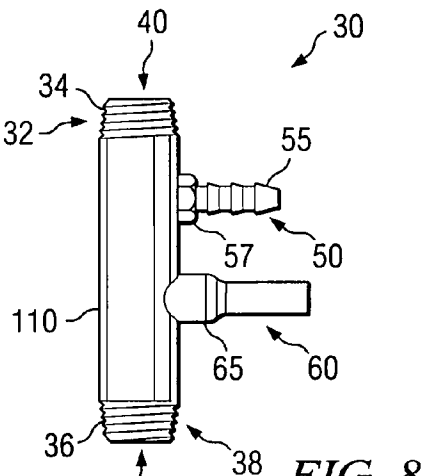
FIGS. 6-8 are configurations of a tailpiece that can connect to a bathroom sink.
Figure 7:
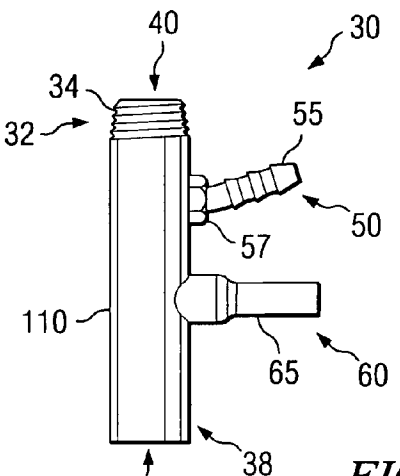
Figure 6:
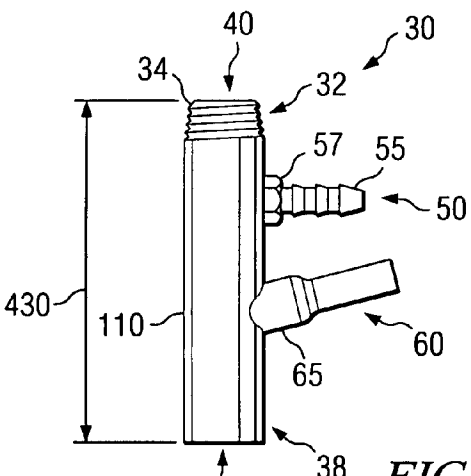

FIGS. 6-8 are generally illustrative of configurations of the tailpiece 30 that can be utilized below a bathroom sink 160. The tailpieces 30 of FIGS. 6-8 generally include a tubular member 110, a dryer drainage connector 55 (that defines a second fluid inlet 50), and a washing machine connector 65 (that defines a third fluid inlet 60). The tubular members 110 include a first end 32 (that defines a first fluid inlet 40) and a second end 38 (that defines a fluid outlet 70). The first end 32 of the tailpieces 30 are shown with a threaded portion 34. The threaded portion 34 can generally be arranged and designed to couple with the T-connector 180 (FIG. 2)—e.g., the T-connector 180 can have a threaded portion that matches up with the threaded portion 34. As referenced above, the second end 38 of tailpiece 30 can be adjustable—e.g., second end 38 can be a slick portion of the tubular member 110 that can be cut down to decrease the length 430.

FIG. 6 shows the washing machine connector 65 coupled at an angle to the tubular member 110 while FIG. 7 shows the dryer drainage connector 55 coupled at an angle to the tubular member 110. Such a feature is intended as showing that the coupling of the washing machine connector 65 and dryer drainage connector 55 can be accomplished in a variety of manners.

FIG. 8 is a similar configuration to FIG. 5, showing a threading 36 on a second end 38 of the tubular member 110. Thus, in configurations in which threading 36 is desirable on the second end 38 and the second end 38 is also desired to be adjustable, the threading 36 can simply extend a length up the tubular member 110 such that the threading 36 will be present upon a cutting off a portion of the second end 38.

With the general description described above with reference to FIGS. 3-8, it should be understood that any of the concepts described with reference to FIGS. 3-5 can be utilized in FIGS. 6-8 and vice versa. Additionally, with the different configurations of tailpieces 20, 30 and different connectors (e.g., the washing machine connector 65 and the dryer drainage connector 55), an intrusion into an internal bore of the tailpieces 20, 30 is preferably minimized. For example the extension of a portions of the different connectors (e.g., the washing machine connector 65 and the dryer drainage connector 55) into a flow area through the tailpieces 20, 30 is minimized. In other configurations, the extension of portions of the different connectors (e.g., the washing machine connector 65 and the dryer drainage connector 55) into a flow area through the tailpieces 20, 30 may not be minimized. Such a configuration helps facilitate a flow from the sinks 140, 160 to the piping 130.

Figure 9:
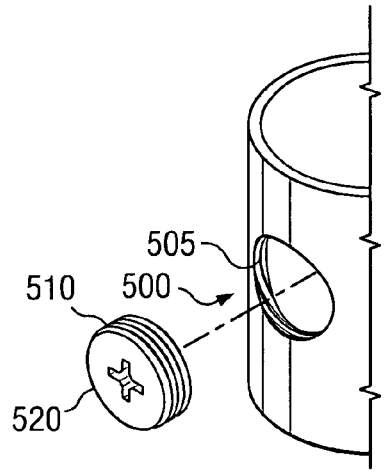
FIGS. 9 is an illustration of a port and a plug that can be utilized with configurations of the invention.
Figure 10:
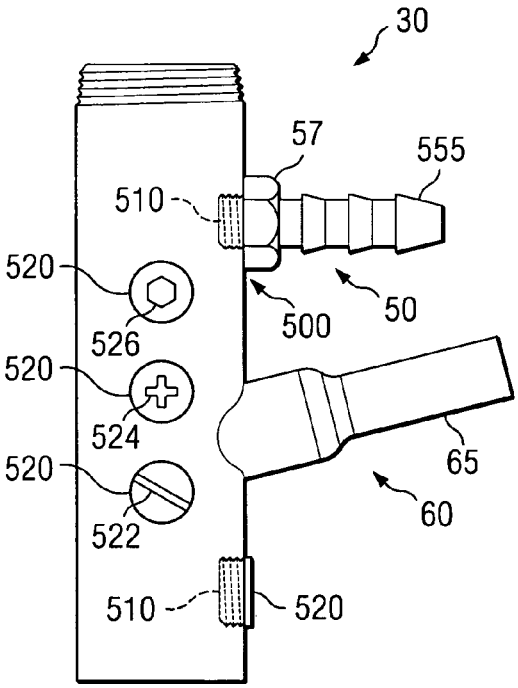
FIGS. 10-11 are configuration of tailpieces with ports and plugs.
Figure 11:
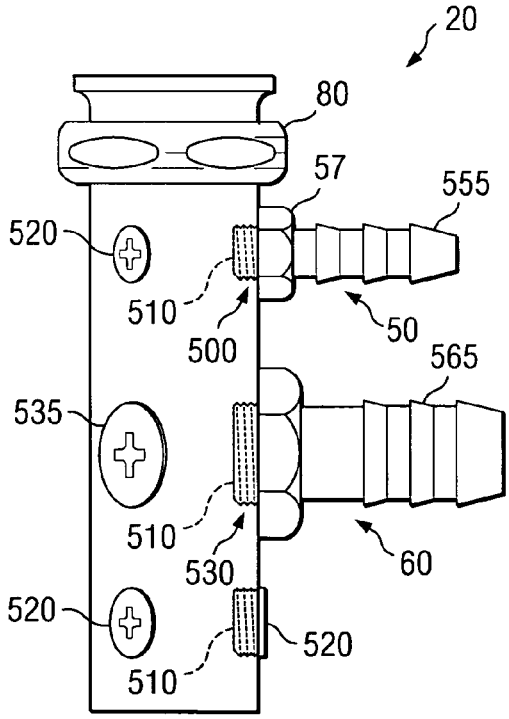
Figure 12:
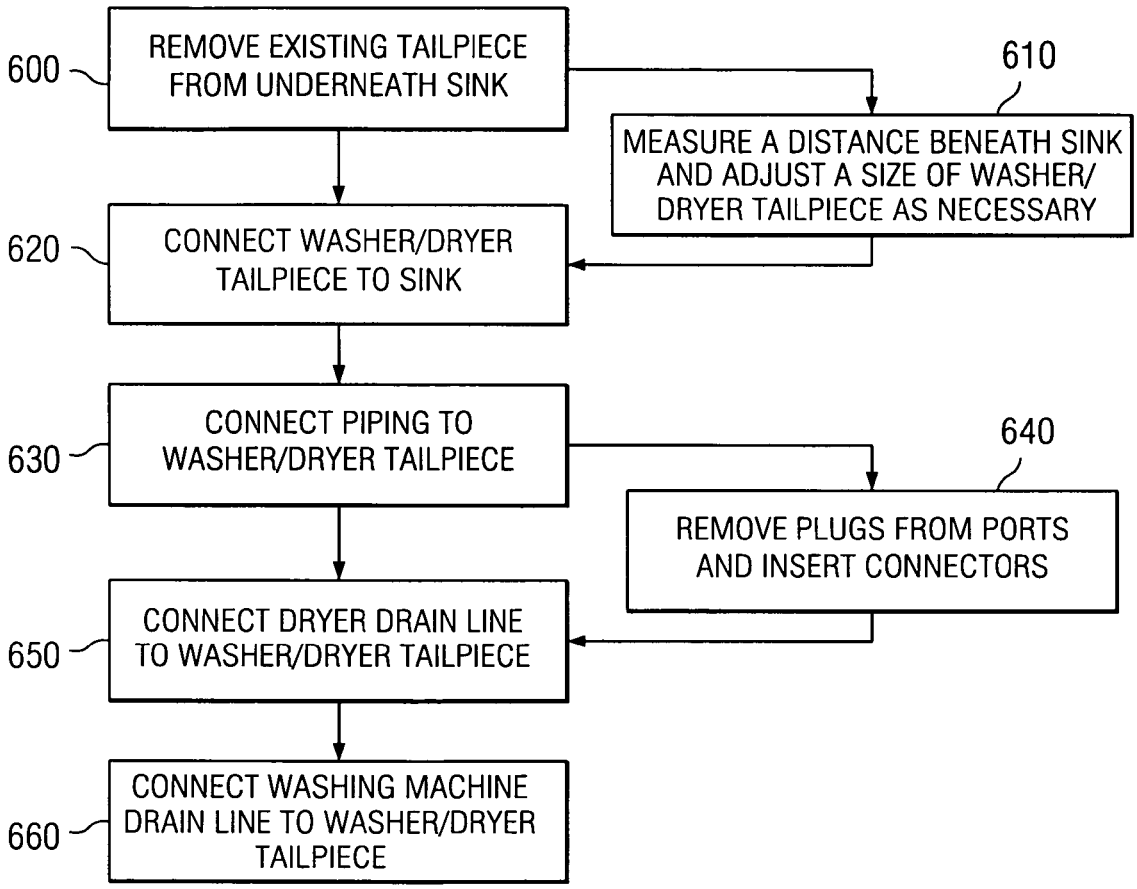
FIG. 12 is an illustration of a process for installing a tailpiece.

FIGS. 9-11 illustrate another aspect of the invention. In FIGS. 9-11, the tailpieces 20, 30 are shown with a plurality of holes or ports 500 and an object disposed therein. The objects shown disposed within the ports 500 are either a plug 520, a dryer drainage connector 555, or a washing machine connector 565. The utilization of ports 500 not only allows an inlet to be placed at a plurality of locations along the tubular member 100,110 but also allows for the quick creation of a new inlet. As an example, intended for illustrative purposes only, in some configurations two inlets may be desirable (e.g., an inlet for a dryer drainage connector 555 and an inlet for a washing machine connector 565). In other configurations three or more inlets into the tubular member 100,110 may be desirable (e.g., an inlet for a dryer drainage connector 555, an inlet for a washing machine connector 565, and an inlet for a dishwasher). Such inlets can easily be created by removal of a plug 520 and insertion of the appropriate connector into the tubular member 100,110.

FIG. 9 is generally illustrative of placement of a plug 520 in a port 500. The plug 520 includes threading 510 while the port 500 includes threading 505. The plug 520 can be placed in the port 500 by a rotational interaction of the corresponding threadings 510, 505. In this coupling, any of a variety of washers, gaskets, or the like can be utilized to fluidly seal the plug 520 within the port 500.

FIG. 10 generally shows a dryer drainage connector 555 disposed within one of the ports 500. In a manner similar to coupling of a plug 520 to the port 500, the drainage connector 555 can include threading 510 to fluidly seal the port 500. In the positioning/placement and/or removing plugs 520 and/or a dryer drainage connector 555 with respect to the ports 500, any of a variety of techniques can be utilized. For example, the plugs 520 are shown with a flathead configuration 522, phillips head configuration 524, and an allen head configuration 526. The base of the dryer drainage connector 555 is show with a hexagonal nut 57. The tools corresponding to these configurations should become apparent to one of ordinary skill in the art. Other techniques and/or configurations should become apparent to one of ordinary skill in the art.

FIG. 10 also shows that a combination of port connectors (e.g., dryer drainage connector 555 ) and permanently coupled connectors (e.g., the washing machine connector 65) can be utilzied in one tailpiece 20.

FIG. 11 generally shows a washing machine connector 565 disposed within a port 530 and a dryer drainage connector 555 disposed within a port 500. With this configuration, it can be seen that the ports 500, 530 can vary in size. And, as such, larger plugs 535 can be utilized to fill ports 530.

With the general description of the configurations of FIGS. 9-11, it can be see that an inlet can be created in a tailpiece 20, 30 without rotating the tailpiece 20, 30 in the particular direction an inlet is desired. Additionally, as additional inlets are needed—e.g., at different time periods, a plug 520, 535 can simply be removed and a connector can be attached to the tailpiece 20, 30.

With reference to FIGS. 1-11, it can be seen that fluid communication between the piping 130 and the discharge of fluids from the washer and 300 and/or dryer 310 can easily be created without resorting to extraordinary plumbing efforts. An example of a process, intended for illustrative purposes only, follows in FIG. 12. If a standard tail piece currently exists underneath a sink (e.g., kitchen sink 140 or bathroom sink 160), such a standard tail piece can be removed at step 600—e.g., by unscrewing slip nuts and unscrewing such standards tail pieces. A variety of removal techniques exist—each determinant on the specific configuration underneath the sink (e.g., a kitchen sink 140 or a bathroom sink 160). At step 610 and after removal of the standard tailpiece, a distance 400,420 can cross-referenced against lengths 410, 430 and the tailpiece 20, 30 can be adjusted as necessary—e.g., from the second end 28, 38 of the tailpiece 20, 30. In some configurations, step 610 may not be needed; rather, the process moves onto step 620. At steps 620 and 630, the tailpieces are connected to the sink (e.g., a kitchen sink 140 or a bathroom sink 160) and the piping 130. If the configuration is similar to FIG. 1, the tailpiece 20 can be positioned up against the threaded portion 146 of the strainer 142, whereupon the nut 80 is rotated onto the threaded portion 146, thereby coupling the tailpiece 20 to the strainer 142. After such coupling, the nut 120 of the piping 130 can be rotated to couple the piping 130 to the tailpiece 20. If the configuration is similar to FIG. 2, the threaded portion 34 of the first end 32 of the tailpiece 30 is threaded into the T-connector 180. After such coupling, the nut 120 of the piping 130 can be rotated to couple the tailpiece 30 to the piping. Other similar coupling techniques can be utilized for other configurations as will become apparent to one of ordinary skill in the art. At a step 640 and if the tailpiece 20, 30 has ports 500, plugs 520, 535 can be removed and connectors (e.g., washing machine connector 665 and dryer drainage connector 555) can be coupled to any of the variety of ports to facilitate a fluid communication. In other processes, step 640 is not applied; rather, the process continues from step 630 to step 650. Fluid communication can then be established via a coupling of the dryer drain line 330 to the dryer drainage connector 55, 555 (step 650) and a coupling of the washing machine drain line 320 to the washing machine connector 65, 665 (step 660).

Thus, it is apparent that there has been provided, in accordance with the present invention, a washer/dryer plumbing connection and method that satisfies one or more of the advantages set forth above. Although the preferred embodiment has been described in detail, it should be understood that various changes, substitutions, and alterations can be made herein without departing from the scope of the present invention, even if all of the advantages and benefits identified above are not present. For example, the various elements or components may be combined or integrated in another system or certain features may not be implemented. Also, the techniques, systems, sub-systems, and methods described and illustrated in the preferred embodiment as discrete or separate may be combined or integrated with other systems, techniques, or methods without departing from the scope of the present invention. For example, features described with reference to tailpiece 20 can be utilized with tailpiece 30 and vice versa. Other examples of changes, substitutions, and alterations are readily ascertainable by one skilled in the art and could be made without departing from the spirit and scope of the present invention.

What is claimed is:

1. An improved tailpiece for replacing a standard tailpiece beneath a sink, the improved tailpiece comprising:

a tubular member having a first end and a second end, wherein the tubular member is coupled between a drain opening of the sink and drain piping beneath the sink;

a washing machine connector coupled to the tubular member, wherein the washing machine connector receives fluid from a washing machine drain line; and a dryer drainage connector coupled to the tubular member, wherein the dryer drainage connector receives fluid from a dryer drain line;

wherein the improved tailpiece receives fluid from at least the sink, a washing machine coupled to the washing machine drain line, and a dryer coupled to the dryer drain line.

2. The improved tailpiece of claim 1, wherein the washing machine connector and the dryer drainage connector are directly coupled to the tubular member.

3. The improved tailpiece of claim 1, wherein the dryer drainage connector is branched from the washing machine connector.

4. The improved tailpiece of claim 1, wherein the first end is threaded and the second end is adjustable.

5. The improved tailpiece of claim 4, wherein the second end includes threading.

6. The improved tailpiece of claim 1, wherein the first end has a nut and the second end is adjustable.

7. The improved tailpiece of claim 6, wherein the second end includes threading.

8. The improved tailpiece of claim 1, wherein the dryer drainage connector has a barbed configuration.

9. The improved tailpiece of claim 8, wherein the washing machine connector has a barbed configuration.

10. The improved tailpiece of claim 1, wherein the washing machine connector has a barbed configuration.

11. The improved tailpiece of claim 1, wherein the washing machine connector has a slip-on configuration.

12. The improved tailpiece of claim 1, further comprising:

at least one port, operable to receive a removable plug.

13. The improved tailpiece of claim 1, wherein the first end defines a first fluid inlet and the second end defines a fluid outlet, the first fluid inlet is operable to receive fluid from the sink, and the fluid outlet is operable to deliver fluid from the sink, the washing machine connector, and the dryer drainage connector to the piping.

14. The improved tailpiece of claim 1, wherein the first end is directly coupled to a drain of the sink.

15. The improved tailpiece of claim 1, wherein the first end is directly coupled to a strainer of the sink.

16. The improved tailpiece of claim 1, wherein the first end is indirectly coupled to a drain of the sink through a T-connecter.

17. The improved tailpiece of claim 1, further comprising:

a dishwasher connector coupled to the tubular member, wherein the dishwasher connector receives fluid from a dishwasher drain line.

18. The improved tailpiece of claim 12, wherein the at least one port comprises a plurality of ports, operable to receive a plurality of connectors.

19. The improved tailpiece of claim 18, wherein the plurality of ports includes ports of at least two different sizes.

20. The improved tailpiece of claim 18, wherein the plurality of connectors are threadingly received in the plurality of ports.

21. The improved tailpiece of claim 12, wherein the removable plug is threadingly received in the at least one port.

22. The improved tailpiece of claim 1, wherein both the washing machine connector and the dryer drainage connector are coupled to the tubular member along an outer circumferential surface of the tubular member.

* * * * *